US006547383B2

(12) United States Patent
Kuwahara

(10) Patent No.: US 6,547,383 B2
(45) Date of Patent: Apr. 15, 2003

(54) IMAGE FORMING APPARATUS AND IMAGE FORMING METHOD

(75) Inventor: Soichi Kuwahara, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/901,386

(22) Filed: Jul. 9, 2001

(65) Prior Publication Data

US 2002/0054196 A1 May 9, 2002

(30) Foreign Application Priority Data

Jul. 10, 2000 (JP) ..... 2000-213367

(51) Int. Cl.[7] ..... B41J 2/01
(52) U.S. Cl. ..... 347/101; 347/100; 347/43
(58) Field of Search ..... 347/98, 96, 100, 347/101, 106, 43, 15

(56) References Cited

U.S. PATENT DOCUMENTS

| | | | | |
|---|---|---|---|---|
| 4,630,076 A | * | 12/1986 | Yoshimura | 347/98 |
| 5,933,164 A | * | 8/1999 | Sato et al. | 347/100 |
| 6,135,656 A | * | 10/2000 | Kato et al. | 347/14 |
| 6,296,342 B1 | * | 10/2001 | Oikawa | 347/21 |
| 6,394,569 B1 | * | 5/2002 | Zeman | 347/98 |

* cited by examiner

*Primary Examiner*—Anh T.N. Vo
*Assistant Examiner*—Manish S. Shah
(74) *Attorney, Agent, or Firm*—Sonnenschein, Nath & Rosenthal

(57) ABSTRACT

The invention relates to a printer and a method of driving the printer. It is an object of the invention to reduce graininess using a simple structure by applying the invention to a thermal inkjet printer. To achieve this, diffusion liquid is previously adhered to an ink adhering location, and the amount of diffusion liquid is controlled.

33 Claims, 8 Drawing Sheets

IMAGE FORMING APPARATUS AND IMAGE FORMING METHOD

RELATED APPLICATION DATA

The present application claims priority to Japanese Application No. P2000-213367 filed Jul. 10, 2000, which application is incorporated herein by reference to the extent permitted by law.

BACKGROUND OF THE INVENTION

1. Field of the Invention

The present invention relates to a printer and a printer driving method. The present invention is, in particular, applicable to an inkjet printer such as a thermal inkjet printer. The present invention makes it possible to reduce graininess using a simple structure as a result of previously adhering diffusion liquid to an ink adhering location, and controlling the amount of diffusion liquid.

2. Description of the Related Art

In recent years, there has been an increasing need for colored hard copies. To respond to this need, inkjet printers, such as continuous-vibration-generating (piezoelectric) inkjet printers and thermal (bubble-jet-type) inkjet printers, are constructed so as to print, for example, a desired image by ejecting ink droplets from a nozzle and adhering them to a print material, and so as to produce a tone gradation based on dot density, the dots being formed by adhering the ink droplets to the print material.

In other words, whereas dark-colored locations are produced by ejecting a large number of ink droplets so as to increase dot density, light colored locations are produced by reducing the number of ink droplets so as to reduce dot density.

However, in inkjet printers, since the tone gradation is produced based on dot density, the intervals between adjacent dots are large in the light-colored regions of the printed result, so that the graininess of the printed result becomes pronounced, thereby resulting in the problem of reduced quality of the printed result.

One method of overcoming this problem involves reducing the sizes of dots to values that cause graininess to be unnoticeable as a result of reducing the sizes of ink droplets. However, for practical purposes, it is difficult to reduce the sizes of ink droplets to values that cause the graininess to be unnoticeable. In addition, when the sizes of ink droplets are reduced, it is necessary to considerably increase dot density at the dark-colored locations, thereby resulting in the problem that nozzles must correspondingly be disposed closer together.

Another method of overcoming this problem involves properly using ink types of different densities at the light-colored locations and the dark-colored locations. In this case, however, two heads are required for one color, so that the structure of the heads become complicated, thereby resulting in the problem of increased costs.

As opposed to this, as disclosed in, for example, Japanese Unexamined Patent Application Publication No. 57-109662, diffusion liquid may be adhered to low-density locations of a sheet where dots become sparsely disposed in order to increase the areas of dots and to reduce the density using the diffusion liquid. However, when, as in this method, the areas of the dots at the locations where they become sparsely disposed are increased using the diffusion liquid, the problem of graininess can be overcome for intermediate tones, whereas, for low-density locations, since the dots are made large, the graininess becomes, on the contrary, pronounced, as a result of which, from the practical point of view, the problem of graininess is not satisfactorily solved yet.

SUMMARY OF THE INVENTION

Accordingly, in view of the above-described problems, it is an object of the present invention to provide a printer which makes it possible to reduce graininess using a simple structure. It is also an object of the present invention to provide a method of driving the printer.

In the present invention, by controlling the amount of diffusion liquid adhered to one location of a print material and the amount of ink adhered to the one location, it is possible to produce a tone gradation at the one location.

In addition, in the present invention, by controlling the amount of diffusion liquid in a dot formed by the diffusion liquid, it is also possible for the size of the dot to become equal to or greater than a predetermined value as required.

Further, in the present invention, by controlling the amount of diffusion liquid adhered to one location of a print material, and the amount of ink adhered to this location in order to produce a tone gradation at this one location, even when the amount of ink is small, it is possible to increase the size of the dot by the amount of diffusion liquid, and, thus, to decrease the dot density. Therefore, it is possible to reduce graininess. Further, by controlling both the amount of ink and the amount of diffusion liquid, it is possible to control the tone gradation in such a way as to produce a fine tone gradation.

Still further, in the present invention, by controlling the amount of diffusion liquid in the dot formed by the diffusion liquid, the size of the dot formed by the ink is such as to be equal to or greater than a predetermined value as required even when the amounts of ink of the dot differ. Therefore, it is possible to form a dot whose size is equal to or greater than the predetermined value even when the amount of ink is small, so that graininess can be reduced.

DESCRIPTION OF THE PREFERRED EMBODIMENT

Hereunder, a description of an embodiment of the present invention will be given with reference to the relevant drawings.

(1) Structure

Figure 2:
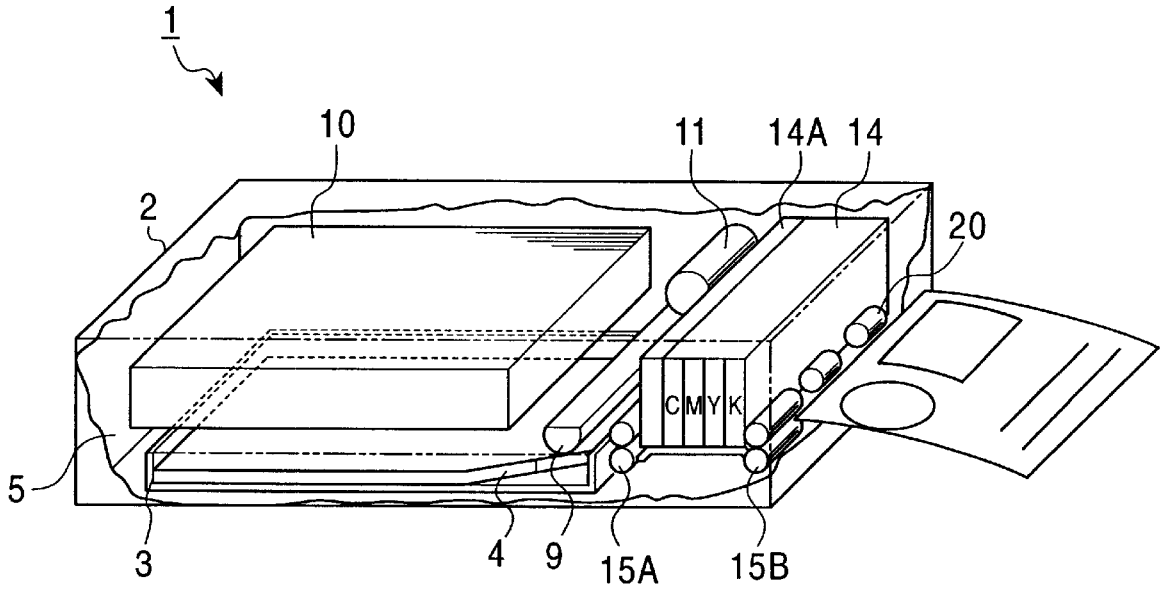
FIG. 2 is a perspective view of the printer shown in FIG. 1.
Figure 3:
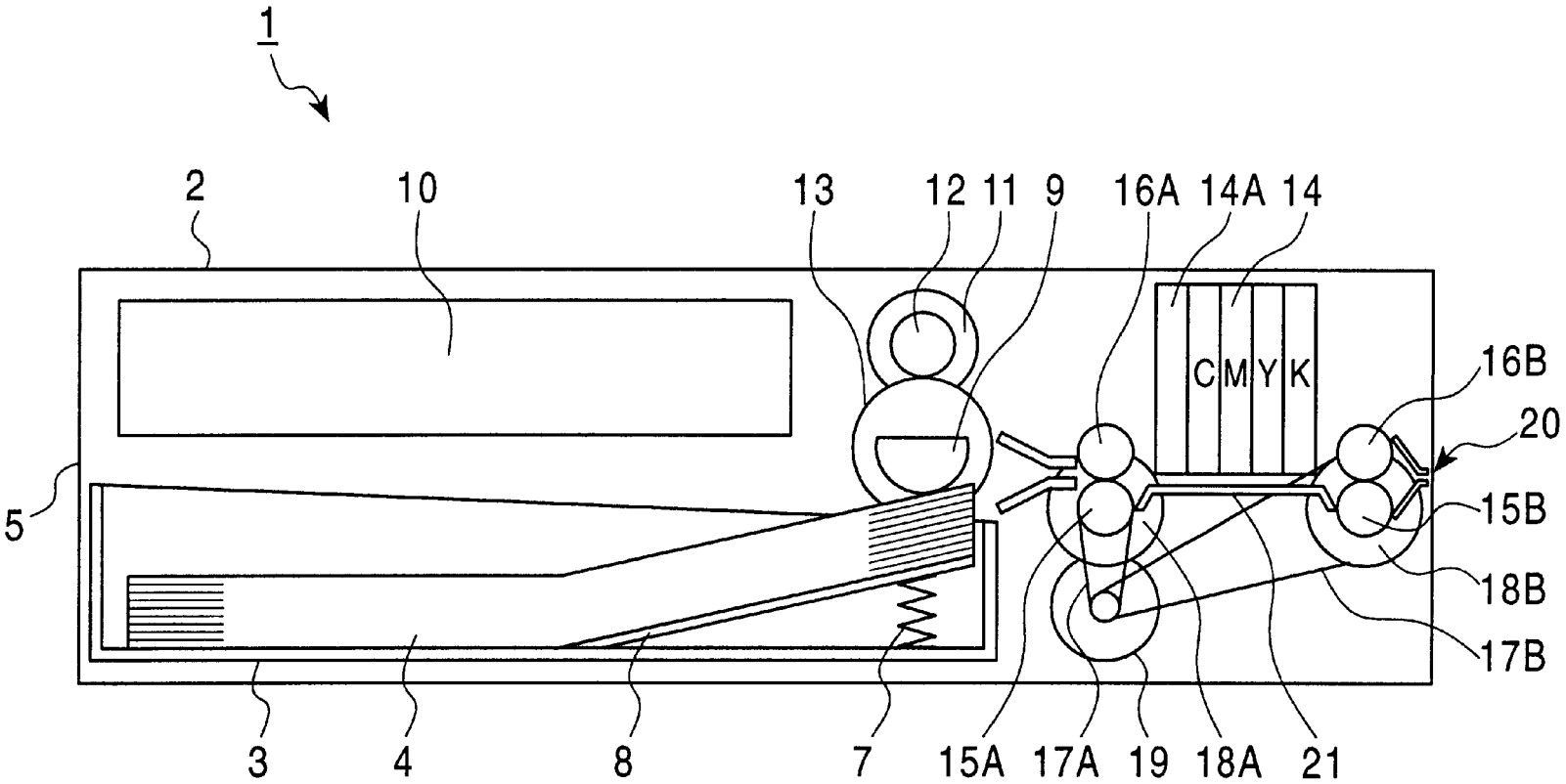
FIG. 3 is a sectional view of the printer shown in FIG. 1.

FIG. 2 is a perspective view of an embodiment of a printer in accordance with the present invention. FIG. 3 is a sectional view thereof. A printer 1 is formed by accommodating it in a rectangular parallelepiped housing 2 which is thin as a whole. A sheet tray 3, holding sheets 4, is mounted from a tray opening 5, formed in the back surface of the housing 2, so as to allow the feeding of the sheets 4.

When the sheet tray 3 is mounted to the printer 1 through the tray opening 5, a sheet support 8 pushes a sheet 4 against a sheet feed roller 9 from the back surface of the sheet 4 by the force of a spring 7. When the rotational force of a sheet feed motor 11, which operates as a result of a controlling operation of an electrical circuit 10 accommodated inside the printer 1, is transmitted by gears 12 and 13, the sheet feed roller 9 feeds the sheet 4 that is pushed against it by the sheet support 8 towards a line head 14.

Along with an opposing roller 16A, a sheet feed roller 15A nips the sheet 4 sent out by the sheet feed roller 9 in this way, and rotates by the rotational force of a sheet feed motor 19 transmitted through a belt 17A and a pulley 18A. Accordingly, the sheet feed roller 15A feeds the sheet 4 towards the line head 14.

A following sheet feed roller 15B is disposed so as to oppose the sheet feed roller 15A, with the line head 14 being disposed therebetween. Along with an opposing roller 16B, the sheet feed roller 15B nips the sheet 4 that has been sent out by the sheet feed roller 15A, and rotates by the rotational force of a sheet feed motor 19 transmitted through a belt 17B and a pulley 18B. Accordingly, the sheet feed roller 15B moves in response to the movement of the sheet feed roller 15A in order to feed the sheet 4 subjected to a printing operation by the line head 14, and to discharge it from a discharge opening 20.

In the printer 1, a flat sheet guide 21 is disposed between the sheet feed rollers 15A and 15B. The line head 14 is disposed above the sheet guide 21, with the sheet 4 being disposed therebetween. The line head 14 has printing ink nozzles and a diffusion liquid nozzle, which are disposed in a row in a direction substantially perpendicular to the direction in which the sheet 4 is fed. Selective driving of these nozzles is performed by the electrical circuit 10 in order to print, for example, a desired image on the sheet 4.

The line head 14 is a head of a thermal inkjet printer in which droplets fly out from a nozzle by heating using a heater. From the sheet-feed side, a diffusion liquid discharging nozzle, a cyan (C) ink discharging nozzle, a magenta (M) ink discharging nozzle, a yellow (Y) ink discharging nozzle, and a black (K) ink discharging nozzle are successively disposed in a row. These nozzles allow printing of, for example, a high-quality color image.

Here, diffusion liquids are liquids which are capable of decreasing the density of ink by spreading the ink on a print material in a planar direction thereof. An example of a diffusion liquid is a liquid which thins ink, such as an organic solvent or transparent, colorless water not including dye or pigment. A diffusion liquid which has less wettability than the ink used with respect to the sheet 4, serving as a print material, that is, a diffusion liquid which does not spread on the sheet 4 more than is necessary when it is adhered thereto and which exists in liquid form for a long period of time is selected. In addition, the diffusion liquid which is selected has excellent wettability with respect to the ink used. Accordingly, when the diffusion liquid is adhered to the sheet 4, it spreads on the surface of the sheet 4 in accordance with the amount thereof. Thereafter, when the ink adheres thereto, the ink diffuses in the diffusion liquid that has spread on the surface of the sheet 4. As a result, in the printer 1, by controlling the amount of diffusion liquid as required, the graininess is reduced.

Figure 1:
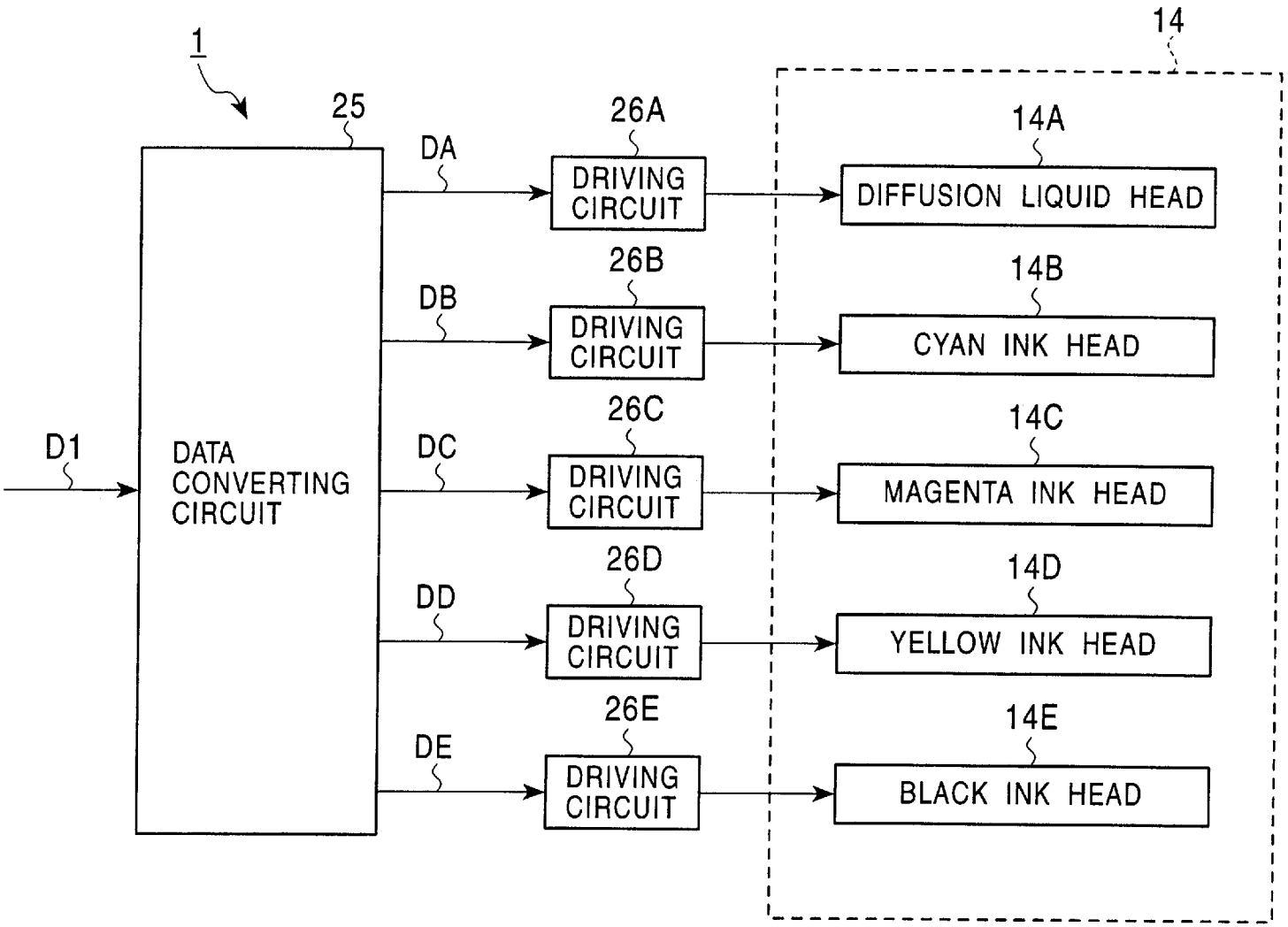
FIG. 1 is a block diagram of the structure of an embodiment of a printer in accordance with the present invention.

FIG. 1 is a block diagram showing a driving system of the line head 14 of the printer 1. In the printer 1, a data converting circuit 25 comprises, for example, a central processing unit, and processes image data and text data D1, input from a host device of, for example, a personal computer in order to generate drive data DA to DE used to drive corresponding color heads 14A to 14E.

Driving circuits 26A to 26E drive the corresponding heads 14A to 14E using the corresponding color drive data DA to DE in order to print, for example, a desired image on the sheet 4.

Figure 4:
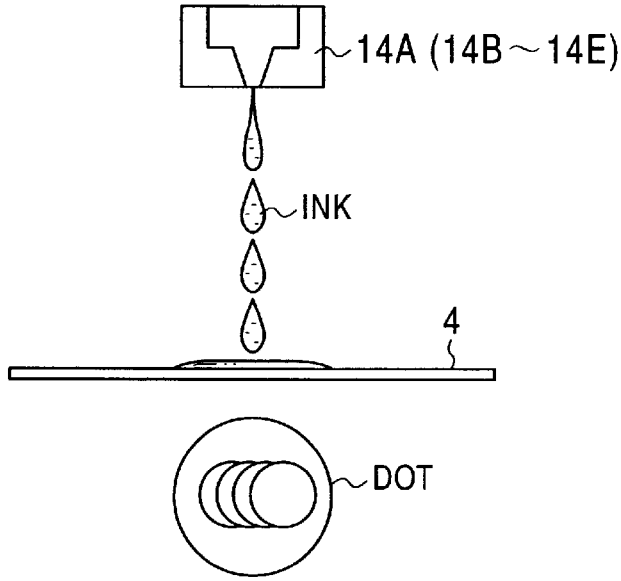
FIG. 4 is a sectional view and a plan view showing the relationship between an ink droplet and a dot in the printer shown in FIG. 1.
Figure 5:
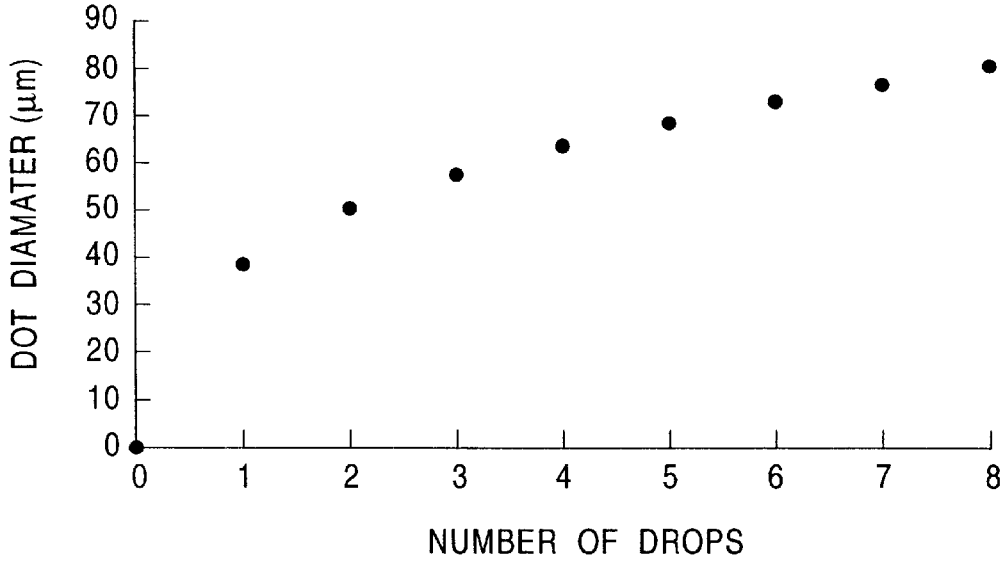
FIG. 5 is a characteristic curve graph showing the relationship between the number of ink droplets and the dot diameter, for a dot that is formed using only ink in the printer shown in FIG. 1.
Figure 6:
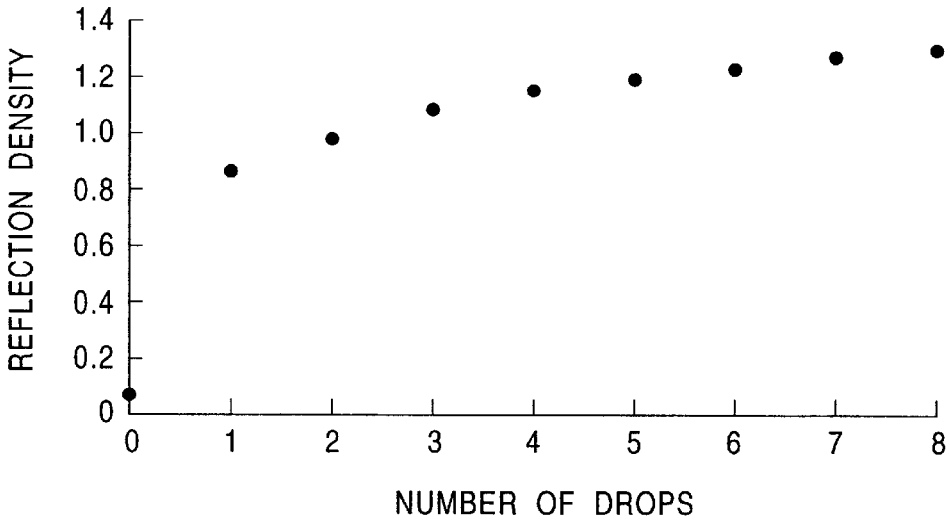
FIG. 6 is a characteristic curve graph showing the relationship between the number of ink droplets and the reflection density, for a dot that is formed using only ink in the printer shown in FIG. 1.

In the driving system of the line head 14 having such a structure, as shown in FIG. 4, the data converting circuit 25 is used to concentrate a plurality of ink drops that are adhered to the sheet 4 in order to produce one dot. The data converting circuit 25 generates the color drive data DB to DE so as to produce corresponding dot tone gradation based on the number of ink drops. In the embodiment, eight ink drops are concentrated at most for one color. Accordingly, when a dot is produced using only ink drops, as shown in FIGS. 5 and 6, a dot diameter and density can be obtained in accordance with the number of ink drops. This method of producing a tone gradation corresponds to what is called PNM (Pulse Number Modulation). In this way, when eight ink drops are concentrated at most for one color, it is possible to obtain nine tone levels for one dot (including the case where no ink is adhered).

In the case where, in this way, each type of color ink is adhered, when the data converting circuit 25 drives the diffusion liquid head 14A, only the required number of drops of diffusion liquid is previously adhered as required to a corresponding location in order to control the dot density and diameter, thereby reducing graininess.

Figure 7:
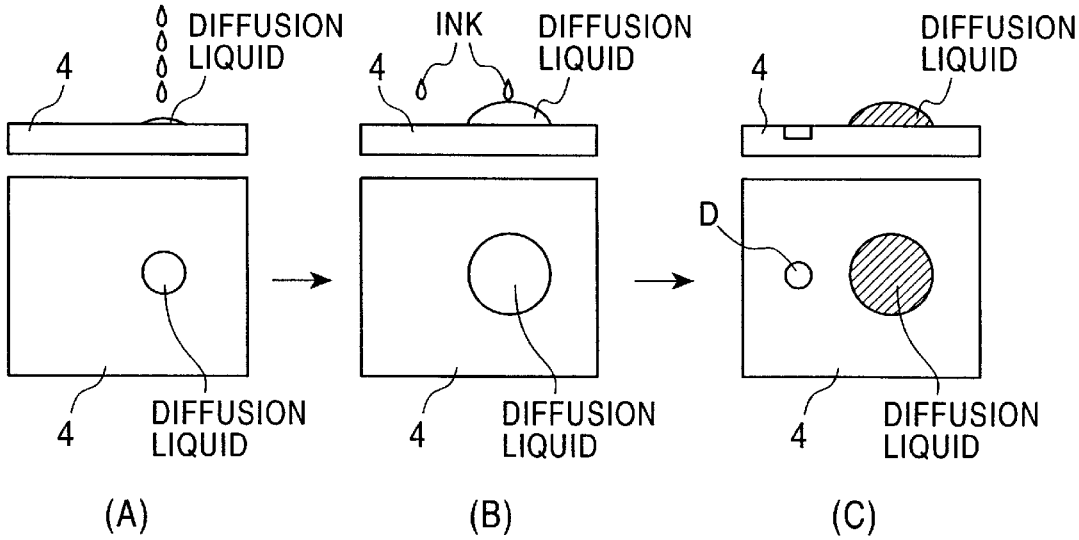
FIGS. 7(A) to 7(C) are side views and plan views used to illustrate the enlarging of a dot using diffusion liquid in the printer shown in FIG. 1.

More specifically, as shown in FIGS. 7(A) to 7(C), the data converting circuit 25 causes the diffusion liquid to be previously adhered to a portion of the sheet 4 where a dot is to be produced as a result of adhering ink thereto. At this time, as shown in FIG. 7(B), in accordance with the content of the image data, the number of diffusion liquid drops is set in order to produce a dot on the sheet 4 by the diffusion liquid. Accordingly, when, for example, ink of a predetermined color is subsequently adhered to the sheet 4, in the embodiment, the ink spreads in the dot by the diffusion liquid in order to produce a large dot having low density, whereas a dot D having a diameter in accordance with the number of drops is produced when no diffusion liquid is adhered to the sheet 4.

An experiment using a 600-DPI head was carried out. The results were as follows. When a dot was produced using only one cyan ink droplet (3[p1]), the dot had a diameter of 38

μm, an area of approximately 1130 $\mu m^2$, and a reflection density of 0.86. When a dot was produced by previously using eight diffusion liquid drops (24[p1]) with respect to one drop of cyan ink, a large, low-density dot having a diameter of 85 μm, an area of approximately 5690 $\mu m^2$, and a reflection density of 0.31 was produced. Therefore, it was possible to correspondingly reduce graininess of the printed result.

Patches having densities of 0.1 were produced for these dots, and the RMS granularities thereof were measured. Measured values of 0.217 and 0.087 were obtained. Incidentally, the RMS granularity σ is a standard deviation of variation in density of a measured region, and is expressed by the following formula (1) when f(i) is the density of each very small region when the measured region is divided into an N number of very small regions, and $f_{ave}$ is the average density:

$$\sigma = \left(\frac{1}{N} \cdot \sum (f(i) - f_{ave})^2\right)^{\frac{1}{2}} \quad (1)$$

The formula shows that the smaller the value, the lower the granularity. The range of Σ is I=1~N.

A dot which was formed using only eight drops (24[p1]) of ink had a diameter of 81.585 μm, an area of approximately 5220 $\mu m^2$, and a reflection density of 1.3, whereas a dot which was formed by previously using eight droplets (24[p1]) of diffusion liquid had a diameter of 105 μm, an area of approximately 8680 $\mu m^2$, and a reflection density of 0.89. Even here, it was possible to reduce the graininess by reducing the density. The RMS granularities of these dots were also measured. The measured values were 0.319 and 0.223, respectively.

In this type of printer, when a very low tone gradation is produced for a wide area, a dot is produced using one ink droplet at one location (hereinafter referred to as "pixel") of locations where a dot can be disposed that are situated next to each other. In such a case, no dot is disposed at a pixel which is adjacent to this dot, so that the graininess becomes very large.

For this reason, in the embodiment, for adjacent pixels having the same tone, the diffusion liquid is adhered to a pixel to which an ink droplet is adhered and the pixels adjacent thereto in order to produce one dot also at such adjacent locations using the diffusion liquid.

Figure 8:
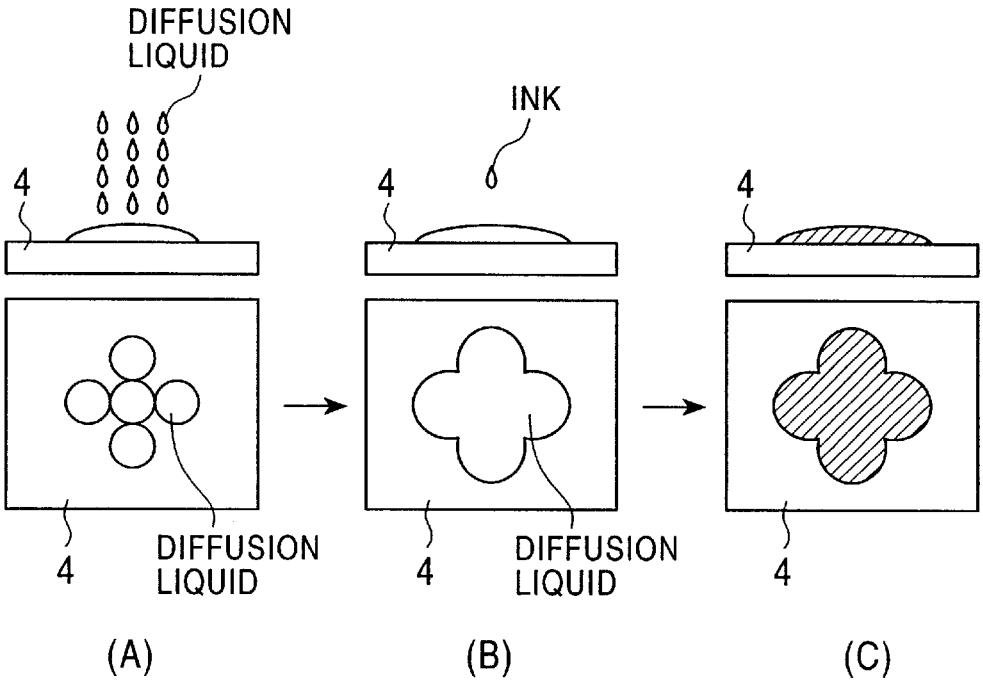
FIGS. 8(A) to 8(C) are side views and plan views used to illustrate the case where the size of a dot is increased at locations including adjacent pixels.

More specifically, as shown in FIGS. 8(A) to 8(C), in the case where, for example, the top, bottom, left, and right adjacent pixels and a center pixel are produced so as to have the same tone, when the tone of each of these pixels is very low, diffusion liquid is adhered to these pixels (FIG. 8(A)), and one dot is produced at these pixels using the diffusion liquid (FIG. 8(B)). Thereafter, a desired ink is adhered thereto. Accordingly, a printing operation is performed on, for example, a large area having a very low tone gradation so as to produce a very high tone gradation. Therefore, the graininess of the printed result is prevented from occurring.

Figure 9A:
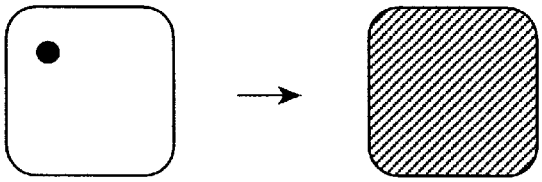
FIGS. 9A and 9B are plan views used to obtain a tone gradation in a low-density region.
Figure 9B:
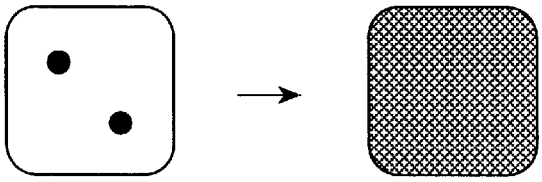

In other words, according to the present invention, it is possible to produce a very high tone gradation, and at the same time to prevent graininess of the printed result. A comparison will be made between the present invention and the conventional method with reference to FIGS. 9A and 9B. In the conventional method, when a low tone gradation is produced at a region having a large area, very small dots as many as are required in accordance with the tone gradation are discretely disposed at the region having a large area. In contrast, in the present invention, as shown by the figures to which the arrows point, the whole region having a large area can be used to produce a tone gradation in accordance with the ink droplets, so that the tone-gradation-producing capability can be correspondingly considerably improved than the conventional tone-gradation-producing capability.

Figure 10:
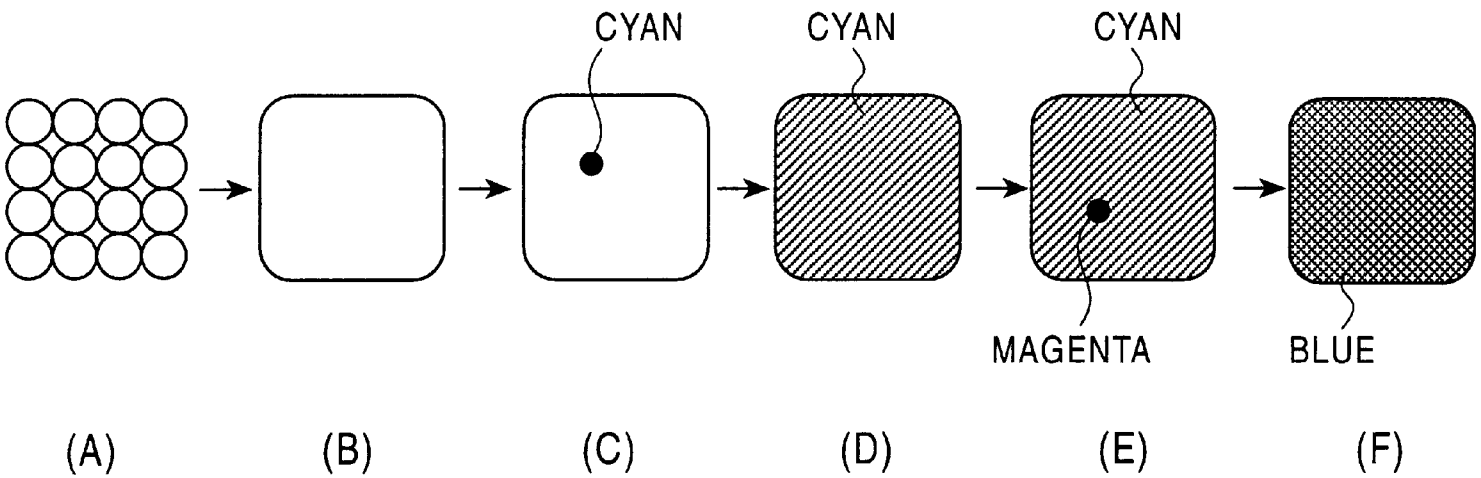
FIGS. 10(A) to 10(F) are plan views used to illustrate the enlargement of a dot by adding ink.

When a printing operation is carried out by these methods using light blue by the addition of cyan and magenta, as shown in FIGS. 10(A) to 10(F), diffusion liquid is adhered to each of the pixels of a corresponding region (FIG. 10(A)), and one dot is produced so as to cover all of these pixels using the diffusion liquid (FIG. 10(B)). Then, for example, one droplet of cyan ink is adhered to the dot (FIG. 10(C)) in order to perform a cyan printing operation at these pixels (FIG. 10(D)). Thereafter, with the dot being sufficiently spread, the following magenta nozzle is used to adhere one drop of magenta ink to the cyan dot (FIG. 10(E)), whereby a light blue dot is printed so as to cover all of these pixels.

Experiments were similarly carried out under the conditions illustrated in FIGS. 8(A) to 8(C) using the 600 -DPI head. The results were as follows. In the case where a dot was produced using only one droplet (3[p1]) of cyan ink, a dot having a diameter of 38 μm, an area of approximately 1130 $\mu m^2$, and a reflection density of 0.86 was used, and eight drops (24[p1]) of diffusion liquid was previously adhered to a pixel where the dot using the cyan ink was to be produced and to pixels disposed above, below, to the left, and to the right of this pixel in order to produce a large dot. Here, it was possible to produce a large, low-density dot having an area of approximately 7300 $\mu m^2$, and a reflection density of 0.16, so that the graininess of the printed result could be correspondingly reduced. In addition, when eight droplets (24[p1]) of diffusion liquid were also previously adhered to the pixels diagonally above and below the pixel where the dot using the cyan ink was to be produced, it was possible to produce a large, low-density dot having an area of approximately 26400 $\mu m^2$, and a reflection density of 0.13. The RMS granularities in these cases were 0.217, 0.043, and 0.03, respectively.

The dot formed by eight drops (24[p1]) of ink had a diameter of 81.585 μm, an area of approximately 5220 $\mu m^2$, and a reflection density of 1.3. In contrast, when eight drops (24[p1]) of diffusion liquid was previously adhered to the pixels above, below, to the right, and to the left of the pixel to which the ink was to be adhered, it was possible to form a large dot having an area of approximately 19400 $\mu m^2$, and a reflection density of 0.56, making it possible to, even in this case, reduce the dot density. When eight drops (24[p1]) of diffusion liquid were previously adhered to the pixels diagonally above and below the pixel where the dot was to be produced, it was possible to produce a low-density dot having an area of approximately 28250 $\mu m^2$, and a reflection density of 0.43. In these cases, the RMS granularities were 0.319, 0.148, and 0.118, respectively.

Here, the number of tone types that can be produced in the present invention will be considered. In the case where the tone gradation is produced using eight ink droplets at most at four pixels, when, in the case where the present invention is not used, the difference between the number of droplets driven into each of the pixels taking into consideration the granularity is 1, the number of tone types that can be produced at the four pixels disposed next to each other in the horizontal direction and the vertical direction is: 8 tone types×4 (number of pixels)+1 (when no drops are driven into the pixels)=33. In contrast, in the embodiment of the present invention, since there are 33 types of tones at these regions in terms of the setting of the diffusion liquid droplets, the number of types of tones as a whole is by a simple calculation: 32 (the number of tone types excluding the case where none are driven in)×33 (the way diffusion liquid is driven)+1 (when no drops are driven in)=1057, so that it is possible to obtain more than 1000 levels of tones.

Figure 11:
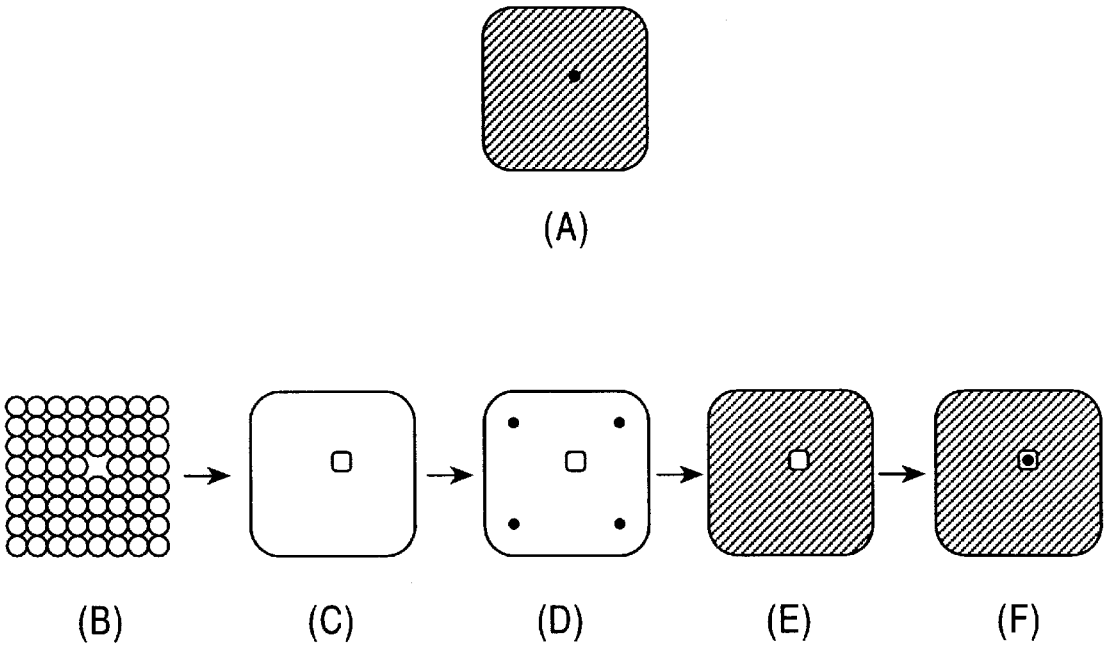
FIGS. 11(A) to 11(F) are plan views used to illustrate the printing of a dot in a region surrounded by a large-area, low-density region.

As shown in FIG. 11(A), when the data converting circuit 25 causes a printing operation to be performed on a very small, high-density region surrounded by a large-area region, using low-density ink, diffusion liquid is adhered to regions other than this very small region (FIG. 11(B)) in order to produce a large dot using the diffusion liquid at the regions other than the very small region (FIG. 11(C)), after which an ink droplet is adhered to the large dot that has been formed using the diffusion liquid (FIG. 11(D)). After the low-density printing operation on the regions other than the very small region (FIG. 11(E)), ink is adhered to the remaining very small region (FIG. 11(F)), whereby the ink adhered to the very small region is such as not to seep out to the regions surrounding it. Depending upon the arrangement of the heads, the order of adhering the ink to the surrounding regions and the very small region can be changed.

(2) Advantages of the Embodiment

In the above-described structure, in the printer 1 (shown in FIGS. 2 and 3), the sheet 4, held by the sheet tray 3, is taken out by the sheet feed roller 9, and is discharged from the sheet-discharge opening 20 by the sheet feed rollers 15A and 15B. When the sheet 4 is being fed between the sheet feed rollers 15A and 15B, ink is adhered to the sheet 4 by the line head 14.

More specifically, the data converting circuit 25 converts the data D1 from the host device into the drive data DB to DE used to drive the corresponding heads 14B to 14F that contains cyan ink, magenta ink, yellow ink, and black ink, respectively. By the drive data DB to DE, the corresponding heads 14B and 14E are driven, so that ink droplets fly from the corresponding heads 14B to 14F towards the sheet 4, serving as a print material, and are adhered thereto, whereby an image or the like is printed using the input data D1.

At this time, in the printer 1, eight ink droplets at most for one color are concentrated, and adhered to the sheet, so that one dot to be formed on the sheet is produced by eight ink droplets at most for one color, thereby producing a tone gradation by controlling the amount of ink for each dot (FIGS. 4 to 6).

In the printer 1, the data converting circuit 25 produces the drive data DA for driving the head 14A for diffusion liquid used to thin the ink. By driving the diffusion liquid head 14A using the drive data DA, a dot is previously produced by the diffusion liquid at a location where a dot is to be formed using the various types of ink.

In the printer 1, the amount of diffusion liquid is variously controlled in accordance with the tone gradation of the portion to be subjected to printing. For each of the dots formed by supplying eight droplets at most for one color, even when the amount of ink is small, large, low-density dots can be produced as required. More specifically, in the printer 1, after a dot of a size corresponding to the number of diffusion liquid drops has been produced by the previous adhesion of the diffusion liquid, ink droplets are subsequently adhered to the dot that has been formed using the diffusion liquid, thereby causing the dot that has been formed by the diffusion liquid to spread, so that a large, low-density dot is formed by the ink (FIGS. 7(A) to 7(C)).

Accordingly, in the printer 1, even when the amount of ink used to form a dot at a light, low-density region is small, a large, low-density dot can be formed as required, thereby making it possible to correspondingly reduce graininess.

When the printer 1 is used to print a region having a plurality of pixels using low-density ink, one droplet of diffusion liquid is adhered to all of the plurality of pixels in order to form a dot. Then, a droplet of desired ink is supplied to this dot formed by adhering the diffusion liquid droplet to all of the pixels, thereby providing the plurality of pixels by the ink thinned by the diffusion liquid (FIGS. 8(A) to 10(F)). Accordingly, in the printer 1, even at locations where the printing is very light as a result of discretely adhering the ink droplets to the plurality of pixels, it is possible to considerably reduce graininess compared to the graininess in the conventional example, so that a high-quality printed result can be correspondingly produced.

By producing a tone gradation as a result of controlling the amount of ink and the amount of diffusion liquid, it is possible to obtain a printed result based on a tone gradation that is finer than that in the conventional example, so that, even in this case, a high-quality printed result can be obtained.

Although in the foregoing description the ink is described as spreading with almost the same density inside the dot formed by the diffusion liquid, such a description has been given only for the sake of simplicity. The ink actually spreads with various density distributions inside the dot formed by the diffusion liquid. In addition, the size and density of the spread dot are only approximations. Actually, the density of the peripheral portion of the dot is smaller, so that it is spread in a smeared state, as a result of which it is difficult to determine the exact size. The smearing effect can also reduce the graininess. It is obvious that the above-described embodiment may be modified within a range not departing from the gist of the present invention. More specifically, the present invention is not limited to the above-described embodiment where eight ink droplets are used for one color of one dot.

(3) Advantages of the Embodiment

By virtue of the above-described structure, by previously adhering diffusion liquid to an ink-adhering location, and controlling the amount of diffusion liquid, the graininess can be reduced using a simple structure, and a printed result of finer tone gradation, and, thus, a high-quality printed result can be obtained compared to conventional printed results.

In addition, by controlling the amount of liquid by controlling the number of droplets as described above, the present invention can be applied to a thermal inkjet printer, thereby making it possible to provide a high-quality printed result.

By selecting a diffusion liquid whose wettability with respect to the print material is less than that of the ink used, it is possible to sufficiently uniformly spread the dot by the diffusion liquid.

(4) Other Embodiment Forms

Although in the above-described embodiment a line printer is described, the present invention is not limited thereto, so that it is widely applicable to a serial head printer. In this case, it is necessary to always drive in the diffusion liquid before the ink, so that it is always necessary to carry out photographic printing towards one side. In carrying out printing towards both sides, it is necessary to selectively drive diffusion liquid heads disposed at both sides of an ink head as viewed in the direction of movement thereof.

Although in the above-described embodiment the case where, for example, a diluted solution which thins the ink is used as a diffusion liquid, the present invention is not limited thereto, so that, for example, a liquid which is capable of spreading the ink used in the planar direction of a sheet as a result of not allowing it to permeate the sheet by being adhered thereto may be used as a diffusion liquid.

Although in the above-described embodiment a printer using a thermal head is described, the present invention is not limited thereto, so that the present invention is widely applicable to a printer in which liquid droplets fly from a nozzle by driving a piezoelectric device.

Although in the above-described embodiment the amount of ink and the amount of diffusion liquid are controlled in terms of the number of droplets of the liquids, the present invention is not limited thereto, so that the present invention is widely applicable to the case where these liquid amounts are controlled by controlling the sizes of the ink droplets themselves.

Accordingly, in the present invention, the graininess can be reduced using a simple structure by previously adhering diffusion liquid to an ink adhering location, and controlling the amount of diffusion liquid.

What is claimed is:

1. An image forming apparatus comprising:

diffusion liquid discharging means for discharging diffusion liquid onto a surface of a recording material in order to adhere the diffusion liquid to the surface of the recording material;

ink discharging means for discharging an ink drop onto the surface of the recording material in order to adhere the ink to the location where the diffusion liquid is adhered on the surface of the recording material; and controlling means for controlling the movements of the diffusion liquid discharging means and the ink discharging means;

wherein the diffusion liquid spreads the ink in a planar direction of the surface of the recording material;

wherein the controlling means controls the amount of diffusion liquid adhered to the surface of the recording material and the amount of ink adhered to the location where the diffusion liquid is adhered in order to control a tone gradation at the location where the ink is adhered; and wherein the controlling means controls the amount of diffusion liquid adhered to the surface of the recording material and the amount of ink adhered to the location where the diffusion liquid is adhered by controlling the number of droplets of the diffusion liquid and the number of droplets of the ink.

2. An image forming apparatus according to claim 1, wherein the diffusion liquid has lower wettability with respect to the recording material than the ink.

3. An image forming apparatus comprising:

diffusion liquid discharging means for discharging diffusion liquid onto a surface of a recording material in order to adhere the diffusion liquid to the surface of the recording material;

a plurality of ink discharging means, provided in accordance with different colors, for discharging ink droplets of different colors onto the surface of the recording material in order to adhere the ink droplets of different colors to the location where the diffusion liquid is adhered on the surface of the recording material; and controlling means for controlling the movements of the diffusion liquid discharging means and the plurality of ink discharging means;

wherein the diffusion liquid spreads the ink droplets of different colors in a planar direction of the surface of the recording material;

wherein the controlling means controls the amount of diffusion liquid adhered to the surface of the recording material and the amount of ink of different colors adhered to the location where the diffusion liquid is adhered in order to control a tone gradation at the location where the ink droplets of different colors are adhered; and wherein the controlling means controls the amount of diffusion liquid adhered to the surface of the recording material and the amount of ink of different colors adhered to the location where the diffusion liquid is adhered by controlling the number of droplets of the diffusion liquid and the number of droplets of the ink of different colors.

4. An image forming apparatus according to claim 3, wherein the diffusion liquid has lower wettability with respect to the recording material than the ink of different colors.

5. An image forming apparatus for forming an image by discharging an ink droplet onto a surface of a recording material in accordance with image data, the image forming apparatus comprising:

diffusion liquid discharging means for discharging diffusion liquid onto a predetermined pixel location of the surface of the recording material based on the image data in order to adhere the diffusion liquid to the surface of the recording material;

ink discharging means for discharging the ink droplet onto the surface of the recording material in order to adhere the ink to the predetermined pixel location of the surface of the recording material; and controlling means for controlling the movements of the diffusion liquid discharging means and the ink discharging means;

wherein the diffusion liquid spreads the ink in a planar direction of the surface of the recording material;

wherein, based on the image data, the controlling means controls the amount of diffusion liquid adhered to the surface of the recording material and the amount of ink adhered to the predetermined pixel location in order to control a tone gradation at the predetermined pixel location; and wherein the controlling means controls the amount of diffusion liquid adhered to the surface of the recording material and the amount of ink adhered to the predetermined pixel location by obtaining the number of droplets of the ink and the number of droplets of the diffusion liquid required at the predetermined pixel location from the tone gradation included in the image data corresponding to the predetermined pixel in order to discharge the obtained numbers of droplets of the diffusion liquid and the ink from the diffusion liquid discharging means and the ink discharging means, respectively.

6. An image forming apparatus according to claim 5, wherein the diffusion liquid has lower wettability with respect to the recording material than the ink.

7. An image forming apparatus for forming a color image by discharging ink droplets of different colors onto a surface of a recording material in accordance with color image data, the image forming apparatus comprising:

diffusion liquid discharging means for discharging diffusion liquid to a predetermined pixel location of the surface of the recording material based on the color image data in order to adhere the diffusion liquid to the surface of the recording material;

a plurality of ink discharging means, provided in accordance with different colors, for discharging the ink droplets of different colors onto the surface of the recording material in order to adhere the ink of different colors to the predetermined pixel location of the surface of the recording material; and controlling means for controlling the movements of the diffusion liquid discharging means and the plurality of ink discharging means;

wherein the diffusion liquid spreads the ink of different colors in a planar direction of the surface of the recording material;

wherein, based on the color image data, the controlling means controls the amount of diffusion liquid adhered to the surface of the recording material and the amount of ink of different colors adhered to the predetermined pixel location in order to control a tone gradation at the predetermined pixel location; and wherein the controlling means controls the amount of diffusion liquid adhered to the surface of the recording material and the amount of ink of different colors adhered to the predetermined pixel location by obtaining the number of droplets of the ink of different colors and the number of droplets of the diffusion liquid required at the predetermined pixel location from the tone gradation included in the color image data corresponding to the predetermined pixel in order to discharge the obtained numbers of droplets of the diffusion liquid and the ink of different colors from the diffusion liquid discharging means and the plurality of ink discharging means provided in accordance with the different colors, respectively.

8. An image forming apparatus according to claim 7, wherein the diffusion liquid has lower wettability with respect to the recording material than the ink of different colors.

9. An image forming apparatus for forming an image by discharging an ink droplet onto a surface of a recording material in accordance with image data, the image forming apparatus comprising:

diffusion liquid discharging means for discharging diffusion liquid onto a plurality of pixel locations, including a predetermined pixel location, of the surface of the recording material based on the image data in order to adhere the diffusion liquid to the surface of the recording material;

ink discharging means for discharging the ink droplet onto the surface of the recording material in order to adhere the ink to the predetermined pixel location of the surface of the recording material; and controlling means for controlling the movements of the diffusion liquid discharging means and the ink discharging means;

wherein the diffusion liquid spreads the ink in a planar direction of the surface of the recording material;

wherein, based on the image data, the controlling means controls the location to which the diffusion liquid is adhered on the surface of the recording material, the amount of diffusion liquid adhered to the surface of the recording material, and the amount of ink adhered to the predetermined pixel location in order to control a tone gradation at the predetermined pixel location; and wherein the controlling means controls the amount of diffusion liquid adhered to the surface of the recording material and the amount of ink adhered to the predetermined pixel location by obtaining the number of droplets of the ink and the number of droplets of the diffusion liquid required at the predetermined pixel location from the tone gradation included in the image data corresponding to the predetermined pixel in order to discharge the obtained numbers of droplets of the diffusion liquid and the ink from the diffusion liquid discharging means and the ink discharging means, respectively.

10. An image forming apparatus according to claim 9, wherein the controlling means controls the location to which the diffusion liquid is adhered on the surface of the recording material by obtaining a required adhering location from the tone gradation included in the image data corresponding to the predetermined pixel in order to discharge the diffusion liquid to the obtained location from the diffusion liquid discharging means.

11. An image forming apparatus according to claim 9, wherein the diffusion liquid has lower wettability with respect to the recording material than the ink.

12. An image forming apparatus for forming a color image by discharging ink droplets of different colors onto a surface of a recording material in accordance with color image data, the image forming apparatus comprising:

diffusion liquid discharging means for discharging diffusion liquid to a plurality of pixel locations, including a predetermined pixel location, of the surface of the recording material based on the color image data in order to adhere the diffusion liquid to the surface of the recording material;

a plurality of ink discharging means, provided in accordance with different colors, for discharging the ink droplets of different colors onto the surface of the recording material in order to adhere the ink of different colors to the predetermined pixel location of the surface of the recording material; and controlling means for controlling the movements of the diffusion liquid discharging means and the plurality of ink discharging means;

wherein the diffusion liquid spreads the ink of different colors in a planar direction of the surface of the recording material;

wherein, based on the color image data, the controlling means controls the amount of diffusion liquid adhered to the surface of the recording material and the amount of ink of different colors adhered to the predetermined pixel location in order to control a tone gradation at the predetermined pixel location; and wherein the controlling means controls the amount of diffusion liquid adhered to the surface of the recording material and the amount of ink of different colors adhered to the predetermined pixel location by obtaining the number of droplets of the ink of different colors and the number of droplets of the diffusion liquid required at the predetermined pixel location from the tone gradation included in the color image data corresponding to the predetermined pixel in order to discharge the obtained numbers of droplets of the diffusion liquid and the ink of different colors from the diffusion liquid discharging means and the plurality of ink discharging means provided in accordance with the different colors, respectively.

13. An image forming apparatus according to claim 12, wherein the controlling means controls the location to which the diffusion liquid is adhered on the surface of the recording material by obtaining a required adhering location from the tone gradation included in the image data corresponding to the predetermined pixel in order to discharge the diffusion liquid to the obtained location from the diffusion liquid discharging means.

14. An image forming apparatus according to claim 12, wherein the diffusion liquid has lower wettability with respect to the recording material than the ink of different colors.

15. An image forming apparatus for forming an image on a surface of a recording material by adhering an ink droplet to the recording material and successively forming a dot by the ink, the image forming apparatus comprising:

diffusion liquid discharging means for discharging diffusion liquid onto the surface of the recording material in order to form a dot on the surface of the recording material using a predetermined amount of diffusion liquid;

ink discharging means for discharging the ink droplet onto the surface of the recording material in order to adhere the ink to the dot that has been formed on the surface of the recording material by the diffusion liquid; and controlling means for controlling the movements of the diffusion liquid discharging means and the ink discharging means;

wherein the diffusion liquid spreads the ink in a planar direction of the surface of the recording material;

wherein the controlling means controls the amount of liquid of the dot formed on the surface of the recording material by the diffusion liquid, and controls the size of the dot formed by the ink so that the size is equal to or greater than a predetermined value as required; and wherein the controlling means controls the amount of liquid of the dot formed on the surface of the recording material by the diffusion liquid and the amount of ink adhered to the dot formed by the diffusion liquid by controlling the number of droplets of the diffusion liquid and the number of droplets of the ink.

16. An image forming apparatus according to claim 15, wherein the diffusion liquid has lower wettability with respect to the recording material than the ink.

17. A method of forming an image, comprising the steps of:

discharging diffusion liquid onto a surface of a recording material in order to adhere the diffusion liquid to the surface of the recording surface;

discharging an ink droplet onto the surface of the recording material in order to adhere the ink to the location to which the diffusion liquid is adhered on the surface of the recording material;

controlling tone gradation at the location to which the ink is adhered by controlling the amount of diffusion liquid adhered to the surface of the recording material and the amount of ink adhered to the location to which the diffusion liquid is adhered, with the ink spreading inside the diffusion liquid in a planar direction of the surface of the recording material; and wherein the step of controlling the tone gradation is executed by controlling the amount of diffusion liquid adhered to the surface of the recording material and the amount of ink adhered to the location where the diffusion liquid is adhered by controlling the number of droplets of the diffusion liquid and the number of droplets of the ink.

18. A method of forming an image according to claim 17, wherein the diffusion liquid has lower wettability with respect to the recording material than the ink.

19. A method of forming an image, comprising the steps of:

discharging diffusion liquid onto a surface of a recording material in order to adhere the diffusion liquid to the surface of the recording material;

discharging ink, of different colors onto the surface of the recording material in order to adhere the ink of different colors to the location where the diffusion liquid is adhered on the surface of the recording material;

controlling a tone gradation at the location to which the ink of different colors is adhered by controlling the amount of diffusion liquid adhered to the surface of the recording material and the amount of ink of different colors adhered to the location to which the diffusion liquid is adhered, with the diffusion liquid spreading the ink of different colors in a planar direction of the surface of the recording material; and wherein the step of controlling the tone gradation is executed by controlling the amount of diffusion liquid adhered to the surface of the recording material and the amount of ink of different colors adhered to the location where the diffusion liquid is adhered by controlling the number of droplets of the diffusion liquid and the number of droplets of the ink of different colors.

20. A method of forming an image according to claim 17, wherein the diffusion liquid has lower wettability with respect to the recording material than the ink of different colors.

21. A method of forming an image by discharging an ink droplet onto a surface of a recording material in accordance with image data, the method comprising the steps of:

discharging diffusion liquid onto a predetermined pixel location of the surface of the recording material based on the image data in order to adhere the diffusion liquid to the surface of the recording material;

discharging the ink droplet onto the surface of the recording material in order to adhere the ink to the predetermined pixel location of the surface of the recording material;

controlling a tone gradation at the predetermined pixel location by, based on the image data, controlling the amount of diffusion liquid adhered to the surface of the recording material and the amount of ink adhered to the predetermined pixel location, with the diffusion liquid spreading the ink in a planar direction of the surface of the recording material; and wherein the step of controlling the tone gradation is executed by controlling the amount of diffusion liquid adhered to the surface of the recording material and the amount of ink adhered to the predetermined pixel location by obtaining the number of droplets of the ink and the number of droplets of the diffusion liquid required at the predetermined pixel location from the tone gradation included in the image data corresponding to the predetermined pixel in order to discharge the obtained numbers of droplets of the diffusion liquid and the ink.

22. A method of forming an image according to claim 21, wherein the diffusion liquid has lower wettability with respect to the recording material than the ink.

23. A method of forming a color image by discharging ink droplets of different colors onto a surface of a recording material in accordance with color image data, the method comprising the steps of:

discharging diffusion liquid to a predetermined pixel location of the surface of the recording material based on the color image data in order to adhere the diffusion liquid to the surface of the recording material;

discharging the ink droplets of different colors onto the surface of the recording material in order to adhere the ink of different colors to the predetermined pixel location of the surface of the recording material;

controlling a tone gradation at the predetermined pixel location by, based on the color image data, controlling the amount of diffusion liquid adhered to the surface of the recording material and the amount of ink of different colors adhered to the predetermined pixel location, with the diffusion liquid spreading the ink of different colors in a planar direction of the surface of the recording material; and wherein the step of controlling the tone gradation is executed by controlling the amount of diffusion liquid adhered to the surface of the recording material and the amount of ink of different colors adhered to the predetermined pixel location by obtaining the number of droplets of the ink of different colors and the number of droplets of the diffusion liquid required at the predetermined pixel location from the tone gradation included in the color image data corresponding to the predetermined pixel in order to discharge the obtained numbers of droplets of the diffusion liquid and the ink of different colors.

24. A method of forming a color image according to claim 23, wherein the diffusion liquid has lower wettability with respect to the recording material than the ink of different colors.

25. A method of forming an image by discharging an ink droplet onto a surface of a recording material in accordance with image data, the method comprising the steps of:

discharging diffusion liquid onto a plurality of pixel locations, including a predetermined pixel location, of the surface of the recording material based on the image data in order to adhere the diffusion liquid to the surface of the recording material;

discharging the ink droplet onto the surface of the recording material in order to adhere the ink to the predetermined pixel location of the surface of the recording material;

controlling a tone gradation at the predetermined pixel location by, based on the image data, controlling the location to which the diffusion liquid is adhered on the surface of the recording material, the amount of diffusion liquid adhered to the surface of the recording material, and the amount of ink adhered to the predetermined pixel location, with the diffusion liquid spreading the ink in a planar direction of the surface of the recording material; and wherein the step of controlling the tone gradation is executed by controlling the amount of diffusion liquid adhered to the surface of the recording material and the amount of ink adhered to the predetermined pixel location are controlled by obtaining the number of droplets of the ink and the number of droplets of the diffusion liquid required at the predetermined pixel location from the tone gradation included in the image data corresponding to the predetermined pixel in order to discharge the obtained numbers of droplets of the diffusion liquid and the ink.

26. A method of forming an image according to claim 25, wherein the step of controlling the tone gradation is executed by controlling the location to which the diffusion liquid is adhered on the surface of the recording material by obtaining a required adhering location from the tone gradation included in the image data corresponding to the predetermined pixel in order to discharge the diffusion liquid to the obtained location.

27. A method of forming an image according to claim 25, wherein the diffusion liquid has lower wettability with respect to the recording material than the ink.

28. A method of forming a color image by discharging ink droplets of different colors onto a surface of a recording material in accordance with color image data, the method comprising the steps of:

discharging diffusion liquid to a plurality of pixel locations, including a predetermined pixel location, of the surface of the recording material based on the color image data in order to adhere the diffusion liquid to the surface of the recording material;

discharging the ink droplets of different colors onto the surface of the recording material in order to adhere the ink of different colors to the predetermined pixel location of the surface of the recording material;

controlling a tone gradation at the predetermined pixel location by, based on the color image data, controlling the amount of diffusion liquid adhered to the surface of the recording material and the amount of ink of different colors adhered to the predetermined pixel location, with the diffusion liquid spreading the ink of different colors in a planar direction of the surface of the recording material; and wherein the step of controlling the tone gradation is executed by controlling the amount of diffusion liquid adhered to the surface of the recording material and the amount of ink of different colors adhered to the predetermined pixel location by obtaining the number of droplets of the ink of different colors and the number of droplets of the diffusion liquid required at the predetermined pixel location from the tone gradation included in the color image data corresponding to the predetermined pixel in order to discharge the obtained numbers of droplets of the diffusion liquid and the ink of different colors from diffusion liquid discharging means and a plurality of ink discharging means provided in accordance with the different colors, respectively.

29. A method of forming a color image according to claim 28, wherein the step of controlling the tone gradation is executed by controlling the location to which the diffusion liquid is adhered on the surface of the recording material by obtaining a required adhering location from the tone gradation included in the image data corresponding to the predetermined pixel in order to discharge the diffusion liquid to the obtained location.

30. A method of forming a color image according to claim 28, wherein the diffusion liquid has lower wettability with respect to the recording material than the ink of different colors.

31. A method of forming an image on a surface of a recording material by adhering an ink droplet to the recording material and successively forming a dot by the ink, the method comprising the steps of:

discharging diffusion liquid onto the surface of the recording material in order to form a dot on the surface of the recording material using a predetermined amount of diffusion liquid;

discharging the ink droplet onto the surface of the recording material in order to adhere the ink to the dot that has been formed by the diffusion liquid on the surface of the recording material; and controlling a dot diameter so that the size of the dot formed by the ink is equal to or greater than a predetermined value as required by controlling the amount of liquid of the dot formed on the surface of the recording material by the diffusion liquid, with the diffusion liquid spreading the ink in a planar direction of the surface of the recording material.

32. A method of forming an image according to claim 31, wherein the step of controlling the dot diameter is executed by controlling the amount of liquid of the dot formed on the surface of the recording material by the diffusion liquid and the amount of ink adhered to the dot formed by the diffusion liquid by controlling the number of droplets of the diffusion liquid and the number of droplets of the ink.

33. A method of forming an image according to claim 31, wherein the diffusion liquid has lower wettability with respect to the recording material than the ink.

* * * * *